United States Patent [19]

Dominico et al.

[11] Patent Number: 4,669,376

[45] Date of Patent: Jun. 2, 1987

[54] TUBE ALIGNING ASSEMBLY FOR TUBE PRINTER

[75] Inventors: James Dominico, West Paterson; Carlos E. Fardin, Wayne; Ralph G. Alessio, Lyndhurst, all of N.J.

[73] Assignee: Van Dem Machine Corporation, West Paterson, N.J.

[21] Appl. No.: 792,357

[22] Filed: Oct. 29, 1985

[51] Int. Cl.[4] ..... B41F 17/22

[52] U.S. Cl. ..... 101/38 A; 198/378

[58] Field of Search ..... 101/38 R, 38 A, 39, 101/40, 126; 198/378

[56] References Cited

U.S. PATENT DOCUMENTS

| | | | |
|---|---|---|---|
| 2,882,818 | 4/1959 | Vowles | 101/126 |
| 3,097,593 | 7/1963 | Makowski et al. | 101/38 R |
| 3,363,546 | 1/1968 | Johnson | 101/38 R |
| 3,538,845 | 11/1970 | Peck et al. | 101/38 A |
| 3,897,725 | 8/1975 | Derrickson | 101/38 R |
| 4,175,993 | 11/1979 | Robertson | 101/38 A X |

*Primary Examiner*—Clifford D. Crowder

*Attorney, Agent, or Firm*—David A. Jackson

[57] ABSTRACT

A tube printing apparatus includes a rotatable mandrel wheel which successively moves tubes to be printed to different stations of the apparatus; a plurality of mandrels which hold the tubes on the mandrel wheel; a printing station including a printing blanket which prints the tubes successively moved to the printing station in contact with the printing blanket; a tube orienting head which circumferentially orients the tubes which are moved to the printing station so as to always provide printing on the tubes at the same circumferential position thereof; a reciprocating control assembly which intermittently reciprocates the tube orienting into engagement with the tubes at the printing station; a rotating control assembly which intermittently rotationally orients the tubes for printing to a desired circumferential position; and a common drive connected to the reciprocating control assembly, rotating control assembly and printing blanket to synchronously drive each of the same, thereby eliminating any complex electronic synchronous adjustments.

10 Claims, 14 Drawing Figures

TUBE ALIGNING ASSEMBLY FOR TUBE PRINTER

BACKGROUND OF THE INVENTION

The present invention relates generally to apparatus for applying print to the exterior surfaces of tubes and, more particularly, is directed to a tube orienting mechanism for orienting the tubes with respect to a printing blanket such that printing on the tubes always occurs at the same circumferential position thereof.

In general, a variety of machines for applying a decorative print to containers, such as tubes and the like, are known. Such machines generally include an infeed conveyor assembly that transports the tubes to a positioning unit that receives the tubes and moves them into position for transfer to corresponding mandrels located on a rotatable mandrel wheel. After the tubes are received on the corresponding mandrels, the mandrels are rotated into position for the printing operation, whereby a printing blanket is brought into contact with each of the tubes, to place a decorative finish on the outer cylindrical surfaces thereof. Thereafter, the mandrels bearing the tubes are moved to another location where the tubes are dried and then to still another location where a coat of varnish is applied to the decorated outer surface of each tube to finish the decoration thereon. The varnish is then cured at a subsequent station and the tubes are thereafter removed from the mandrel wheel.

With such apparatus, it is necessary to orient the tubes with respect to the printing blanket so that the decorative print is always applied at the same position on the tubes. In this regard, a tube printing apparatus sold by Mall GmbH in Germany includes an orienting head which engages the tube then in contact with the printing blanket. Once the blanket makes contact with the tube, the orienting head backs out and the tube is rotated and printed by the printing blanket. Specifically, the orienting head is controlled to intermittently reciprocate to thereby engage the tube then at the printing station, and is also controlled to continuously rotate to thereby rotate the engaged tube.

In order to provide synchronization between movement of the printing blanket and the orienting head, a separate drive is provided for the orienting head. Specifically, a synchronous motor is used which brings the orienting head up to the surface speed of the printing blanket. A problem with such arrangement, however, is in providing accurate synchronization of the orienting head and the printing blanket. Generally, this must be performed electronically and becomes relatively complex. Furthermore, over periods of time, because of the two different drive systems, movement of the printing blanket and the orienting head move out of phase with each other, resulting in a loss of synchronization.

This loss of synchronization requires stopping of the apparatus to correct the same which, as aforesaid, is relatively complex and which results in down time of the machine. More importantly, because of the two drive system, there is a limiting speed of operation of the apparatus. For example, the Mall printing apparatus is generally limited to printing at the rate of 110 tubes per minute, since otherwise, the apparatus will not orient properly, that is, will not be synchronously timed. This speed limiting factor is inefficient and costly.

OBJECTS AND SUMMARY OF THE INVENTION

Accordingly, it is an object of the present invention to provide tube printing apparatus in which the printing blanket always applies print at the same circumferential position of the tubes.

It is another object of the present invention to provide a tube printing apparatus in which the tube orienting head and printing blanket are synchronously controlled by a common drive.

It is still another object of the present invention to provide a tube printing apparatus having a rate of production of at least 150 tubes per minute.

In accordance with an aspect of the present invention, a tube printing apparatus includes rotatable mandrel wheel means for successfully moving tubes to be printed to different stations of the tube printing apparatus; a plurality of mandrel means for holding the tubes on the mandrel wheel means; a printing station including printing blanket means for printing tubes successively moved to the printing station in contact with the printing blanket means; tube orienting means for circumferentially orienting the tubes successively moved to the printing station; and common drive means connected to the printing blanket means and the tube orienting means for synchronously controlling the tube orienting means to orient the tubes successively moved to the printing station in correspondence with movement of the printing blanket means such that the printing blanket means always applies print at the same circumferential position of the tubes.

The above and other, objects, features, and advantages of the present invention will become readily apparent from the following detailed description thereof which is to be read in connection with the accompanying drawings.

DESCRIPTION OF A PREFERRED EMBODIMENT

Figure 1:
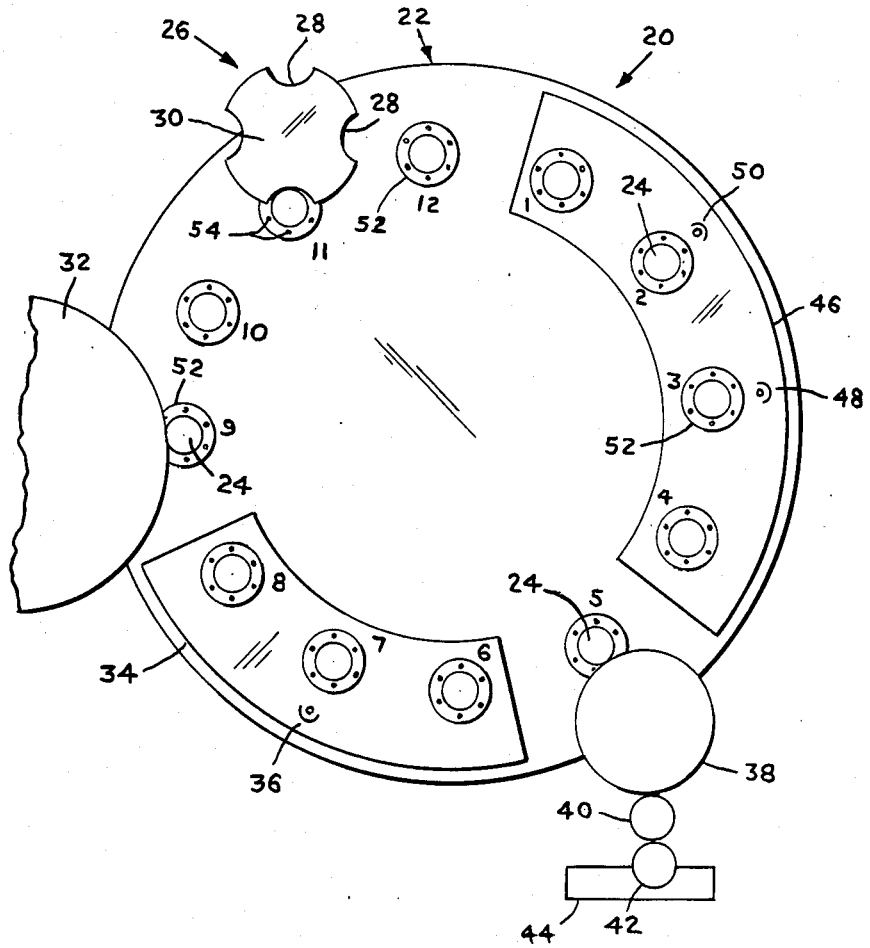
FIG. 1 is a schematic, front elevational view of an intermittently operated tube printing apparatus of the type with which the present invention can be used.

Referring to the drawings in detail, and initially to FIG. 1 thereof, a tube printing apparatus 20 with which the present invention can be used includes a rotatable mandrel wheel 22 having a plurality of, for example, twelve, regularly spaced mandrels 24 mounted along the circumferential periphery thereof. As shown in FIG. 1, the twelve mandrels 24 are equidistantly spaced along the circumferential periphery of rotatable mandrel wheel 22, and for ease of explanation, are shown at the hour positions 1–12 of a clock face.

Tube printing apparatus 20 includes an infeed transfer assembly 26 for transfering the tubes onto mandrels 24 at the eleven o'clock position, as shown in FIG. 1. Specifically, an infeed conveyor (not shown) conveys tubes to a respective pocket 28 of a four-position rotatable star wheel assembly 30 which intermittently rotates in synchronism with mandrel wheel 22 so as to position a tube in front of the mandrel 24. then at the eleven o'clock position of mandrel wheel 22. It will be appreciated that, in order to retain the tubes within pockets 28, star wheel assembly 30 provides a vacuum through respective holes (not shown) in each pocket 28. At the eleven o'clock position, a pusher (not shown) pushes the tube thereat onto the respective mandrel 24.

After a tube is positioned on a respective mandrel 24 at the eleven o'clock position of mandrel wheel 22, the latter is intermittently rotated to the nine o'clock position of mandrel wheel 22 into surface contact with a rotating image-transfer mat or printing blanket designated schematically at 32, that forms part of the printing station of the apparatus 20. Thereafter, the tubes, remaining on mandrels 24, are rotated away from the printing station to a drying or curing station 34, where the print is dried by ultraviolet light. Since the rotational movement is intermittent, the ultraviolet light is sufficient to dry the print. It will be noted that the drying operation occurs only at the seven o'clock position of mandrel wheel 22 as indicated schematically by the lamp 36 thereat. However, drying station 34 also covers the mandrels at the six and eight o'clock positions of mandrel wheel 22 to prevent UV light from escaping the drying station.

Thereafter, the tubes are rotated away from drying station 34 and given a coating of varnish by means of peripheral surface engagement with a varnish applicator roll 38 forming part of the varnishing station of tube printing apparatus 20. Varnish applicator roll 38 is generally made of a rubber or like material and is rotated by suitable tansmission means (not shown). Varnish is applied to varnish applicator roll 38 by steel rolls 40 and 42 which, in turn, are supplied with the varnish from a reservoir 44, as is well known in the art.

The tubes are then transferred to a second drying or curing station 46, where the varnish is dried by ultraviolet light. As with drying station 34, drying station 46 covers the mandrels at the one, two, three and four o'clock positions of mandrel wheel 22, although drying occurs only at the three and two o'clock positions, respectively, as indicated schematically by the lamps 48 and 50 thereat. Drying station 46 extends to the one and four o'clock positions of mandrel wheel 22 to prevent UV light from escaping the drying station.

The tubes are then rotated to the twelve o'clock position of mandrel wheel 22, where they are stripped from the respective mandrel thereat and deposited onto a belt for removal. Specifically, a stripper (not shown) strips the tubes from the mandrel 24 at the twelve o'clock position. In addition, as shown in FIG. 1, a back plate 52 is provided at the proximal or fixed end of each mandrel 24 and includes a plurality of holes 54 through which air is blown at the twelve o'clock position to aid in the removal of the tubes thereat.

With tube printing apparatus 20, it is often necessary to provide print at the same circumferential position on each tube, at the printing station. For example, where the tube is a rigid tube of the type used for pump top toothpaste dispensers, it is necessary to always provide printing at the same circumferential position on each tube, in correspondence with the pump top portion thereof. In this regard, a tube printing apparatus sold by Mall GmbH in Germany is known which includes a tube orienting head that intermittently engages the tubes at the nine o'clock position of mandrel wheel 22 and which rotates the tubes into correct alignment with printing blanket 32, whereby printing occurs at the same circumferential position on each tube.

However, in order to provide synchronization between movement of the printing blanket and the orienting head, a separate drive is provided for the orienting head. It is therefore required to use a separate synchronous motor to bring the orienting head up to the surface speed of the printing blanket. This, however, requires complex electronic adjustment. In addition, over periods of time, synchronization between the printing blanket and orienting head is lost due to the different mechanical movements. This lose of synchronization requires stopping of the apparatus to again provide complex electronic adjustment, and which results in down time of the machine. More importantly, the problem of synchronization provides a limit as to the rate that the tubes can be printed, which limiting factor is inefficient and costly.

Figure 2:
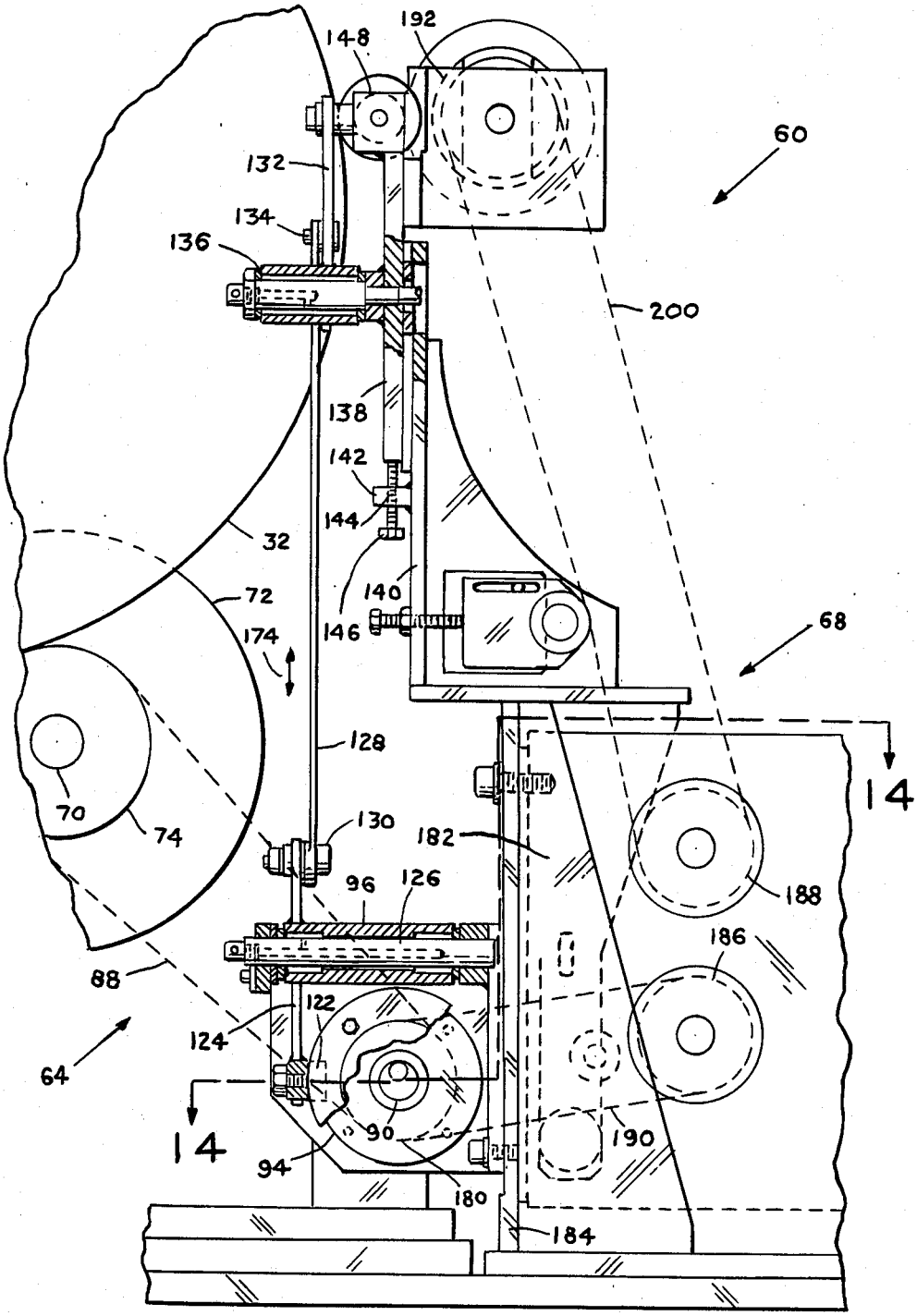
FIG. 2 is a rear elevational view, partly in cross-section, of a tube orienting mechanism of a tube printing apparatus according to the present invention.
Figures 3, 12:
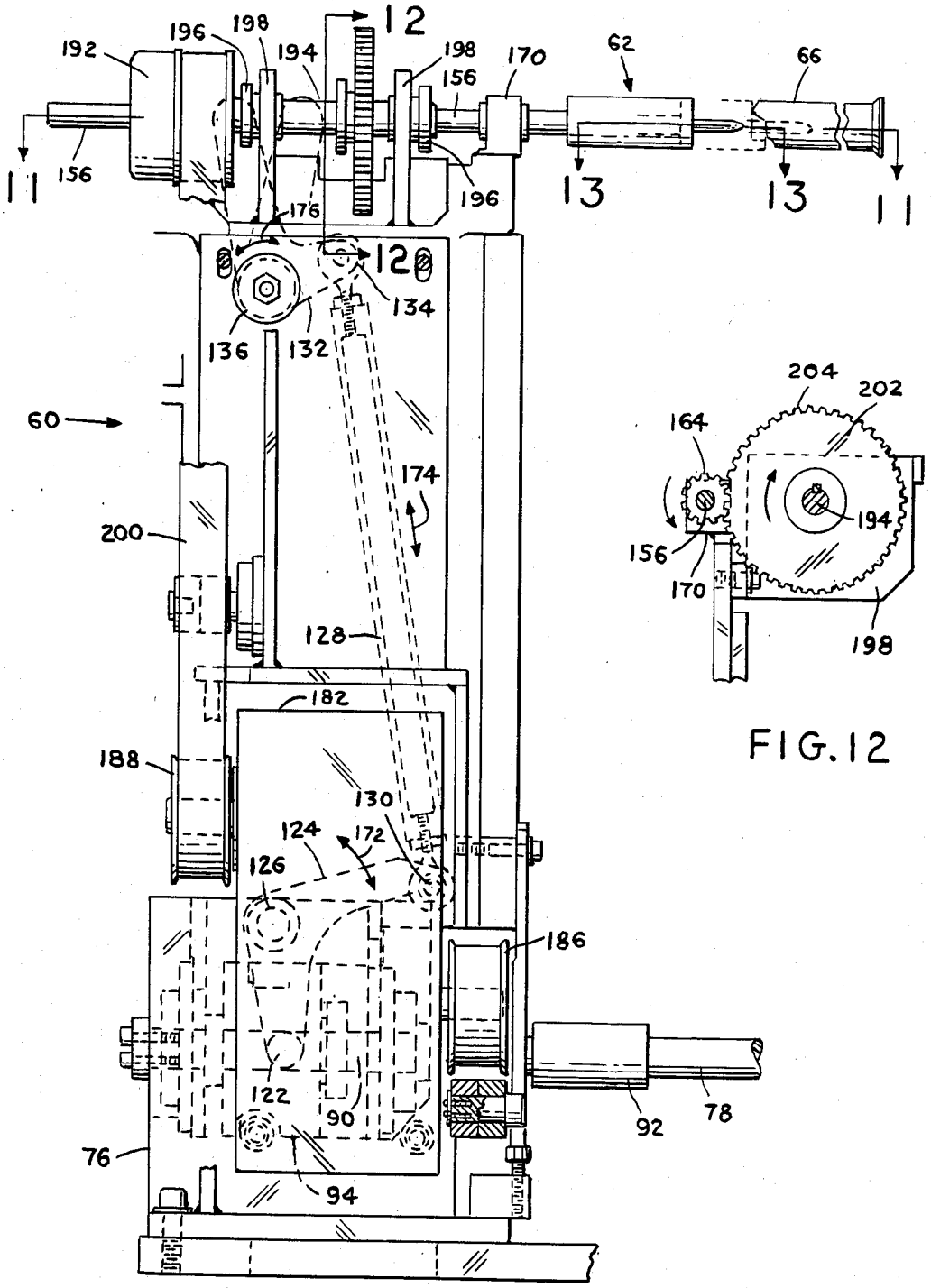
FIG. 3 is a side elevational view, partly in cross-section, of the tube orienting mechanism of FIG. 2.
FIG. 12 is a cross-sectional view of the tube orienting mechanism of FIG. 3, taken along line 12—12 thereof.
Figure 4:
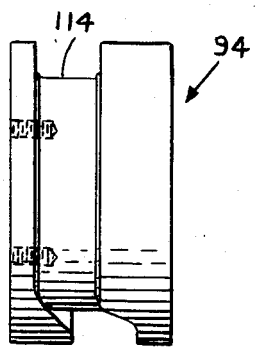
FIG. 4 is a side elevational view of an orienting cam of the tube orienting mechanism of FIG. 2.
Figure 5:
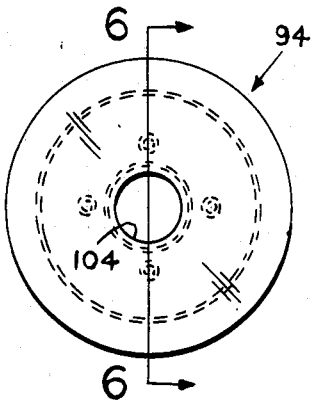
FIG. 5 is an end elevational view of the orienting cam of FIG. 4.
Figure 6:
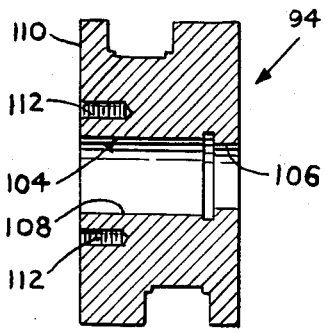
FIG. 6 is a cross-sectional view of the orienting cam of FIG. 5, taken along line 6—6 thereof.

Referring now to FIGS. 2 and 3, a tube orienting assembly 60 according to the present invention, includes a tube orienting head 62, a reciprocating control assembly 64 which controls tube orienting head 62 to intemittently reciprocate toward a tube 66 at the nine o'clock position of mandrel wheel 22, and a rotating control assembly 68 which intermittently rotates orienting head 62 when the latter is reciprocated into engagement with a respective tube 66 so as to correctly align the tube with respect to printing blanket 32. In accordance with an important aspect of the present invention, reciprocating control assembly 64 and rotating control assembly 68 are both driven off the same drive shaft 70 used for rotating printing blanket 32. As a result, the problem of providing the aforementioned complex electronic adjustment is eliminated. In addition, any change in speed of drive shaft 70 which affects the rotational speed of printing blanket 32, will produce a corresponding change in reciprocating control assembly 64 and rotating control assembly 68, so that synchronization is always maintained.

Figure 14:
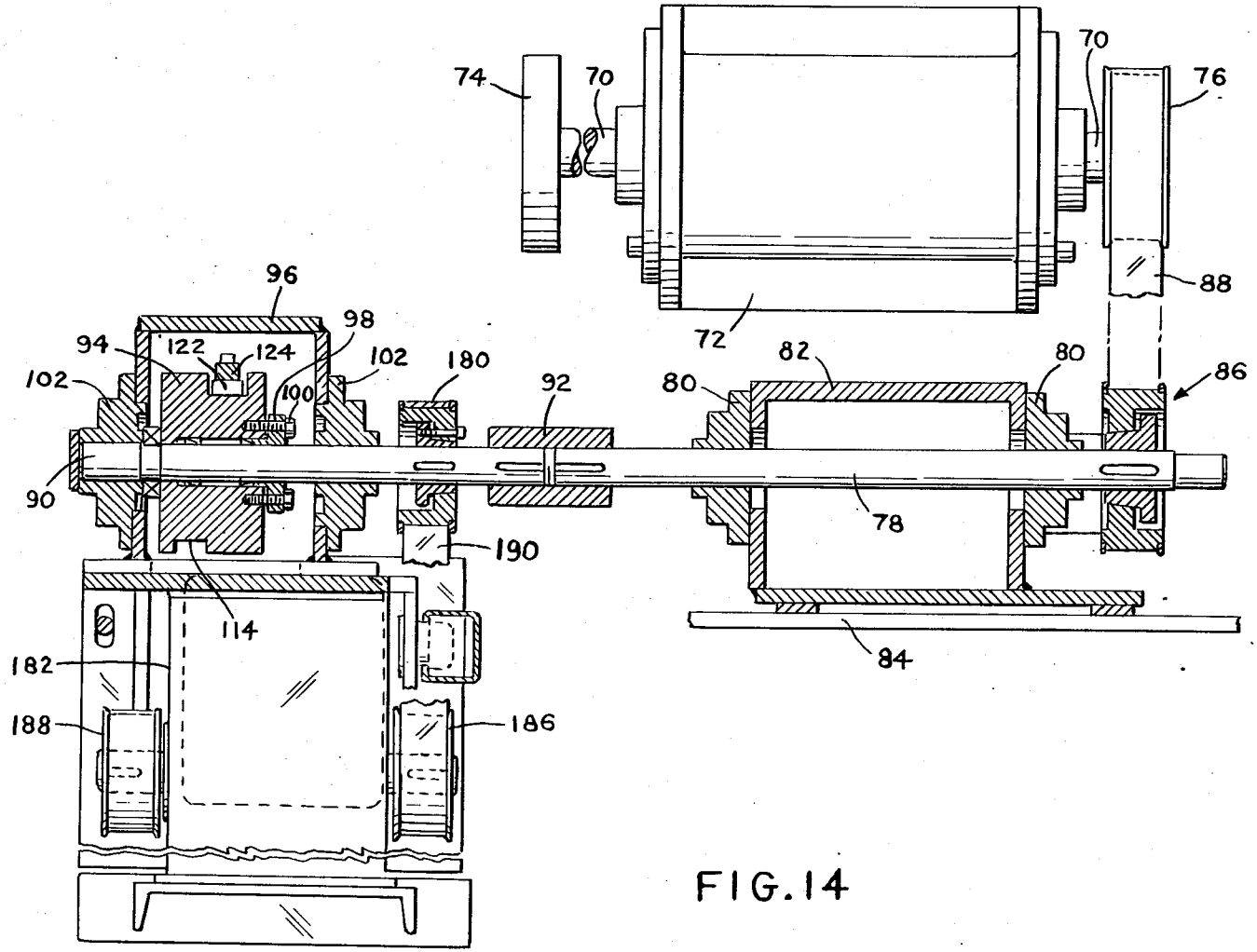
FIG. 14 is a cross-sectional view of the tube orienting mechanism of FIG. 2, taken along line 14—14 thereof.

As shown in FIG. 14, drive shaft 70 is rotated by a motor 72. A gear 74 is secured to drive shaft 70 and engages suitable gearing (not shown) on printing blanket 32 for driving the same. It will be appreciated, however, that any other suitable means may be utilized for driving printing blanket 32 off of drive shaft 70, for example, a pulley arrangement or the like. A pulley 76 is also secured to drive shaft 70, as shown in FIG. 14.

A driven shaft 78 is rotatably journalled within bearings 80 mounted on opposite sides of a bracket 82 secured to a section 84 of the machine housing. A pulley 86 is keyed to driven shaft 78 and a belt 88 connects pulleys 76 and 86. Thus, as shaft 70 rotates, driven shaft 78 is likewise caused to rotate. It will be appreciated that various changes can be made herein. For example, pulleys 76 and 86 can be replaced by sprockets and belt 88 can be replaced by a chain. As shown, driven shaft 78 is coincident with and fixedly coupled to a cam shaft 90 by means of a coupling 92.

Referring now to FIGS. 2, 3 and 14, an orienting cam 94 is fixedly mounted on cam shaft 90 within a cam housing 96. Specifically, a cam clamp 98 is keyed to cam shaft 90 and is secured to orienting cam 94 by bolts 100 so as to fixedly retain orienting cam 94 on cam shaft 90. Cam shaft 90, in turn, is rotatably mounted within bearing assemblies 102 secured to cam housing 96.

Orienting cam 94, as shown with more particularity in FIGS. 4–7, has a generally cylindrical configuration with a central bore 104 formed therein. Central bore 104 includes a first section 106 which has a diameter slightly larger than that of cam shaft 90 and through which the latter extends, and a second contiguous section 108 having a larger diameter and through which cam clamp 98 extends (FIG. 14) for securing orienting cam 94 tocam shaft 90. The end face 110 of orienting cam 94, adjacent to second section 108 of central bore 104, includes at least two screw-threaded apertures 112 through which bolts 104 extend for securing orienting cam 94 to cam clamp 98.

Figure 7:
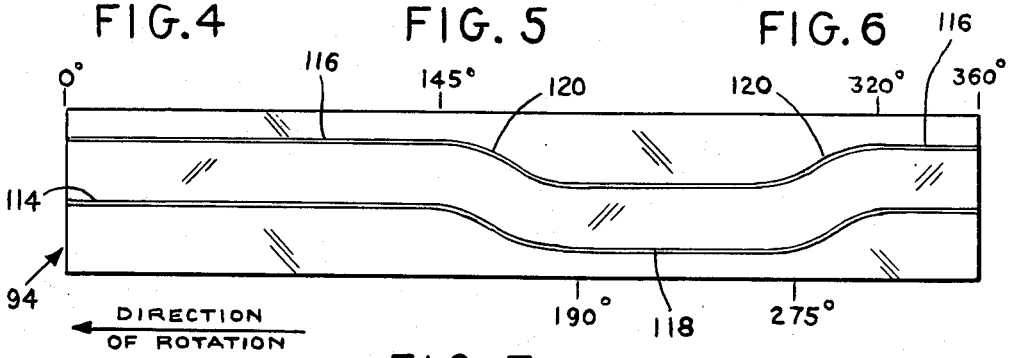
FIG. 7 is a flatened view of the orienting cam of FIG. 4, as if the same were cut and unrolled.
Figure 8:
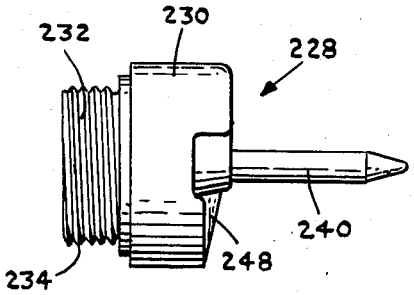
FIG. 8 is a side elevational view of a portion of the orienting head of the tube orienting mechanism of FIG. 2.
Figure 10:
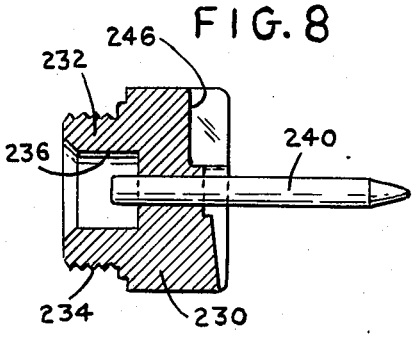
FIG. 10 is a cross-sectional view of the orienting head of FIG. 9, taken along line 10—10 thereof.
Figure 9:
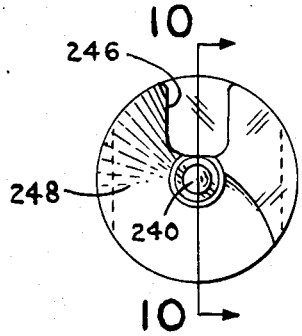
FIG. 9 is a front elevational view of the orienting head of FIG. 8.

As shown, orienting cam 94 includes a circumferential cam track 114 which is shown laid out in FIG. 7. Cam track 114 basically provides a first straight section 116, a second straight section 118 offset from first section 116 in the axial direction of cam 94 and interconnecting sections 120. As will be explained in greater detail hereinafter, by providing offset section 118, reciprocating motion is imparted to orienting head 62. As shown in FIG. 7, first section 116 occupies an angular exteht of approximately 185°, second section occupies an angular extent of approximately 85°, with the interconnecting sections occupying the remaining angular extent.

Referring back to FIGS. 2, 3 and 14, a cam follower 122 rides within cam track 114, and controls reciprocation of tube orienting head 62 in accordance with its position in cam track 114. Specifically, tube orienting head 62 is moved forwardly into engagement with a tube 66 when cam follower 122 rides within second section 118 and is out of engagement with tube 66 when cam follower 122 rides within first section 116.

Cam follower 122 is secured to one end of an L-shaped cam lever 124 which, in turn, is pivotally mounted on a pivot shaft 126 secured to the upper end of cam housing 96. The opposite end of L-shaped cam lever 124 is pivotally secured to one end of a vertically oriented connecting rod 128 by a pivot pin 130. The opposite end of connecting rod 128 is pivotally connected to one end of an upper L-shaped lever 132 by means of a pivot pin 134. Upper L-shaped lever 132 is pivotally connected at the junction of its legs by a pivot shaft 136, to a bracket 138. Bracket 138 is secured to a section 140 of the machine housing in a vertically adjustable manner. Specifically, housing 140 includes a ledge 142 having a screw-threaded bore 144 therethrough through which a bolt 146 extends into a corresponding screw-threaded bore (not shown) in bracket 138 for moving the latter in the vertical direction.

Figure 11:
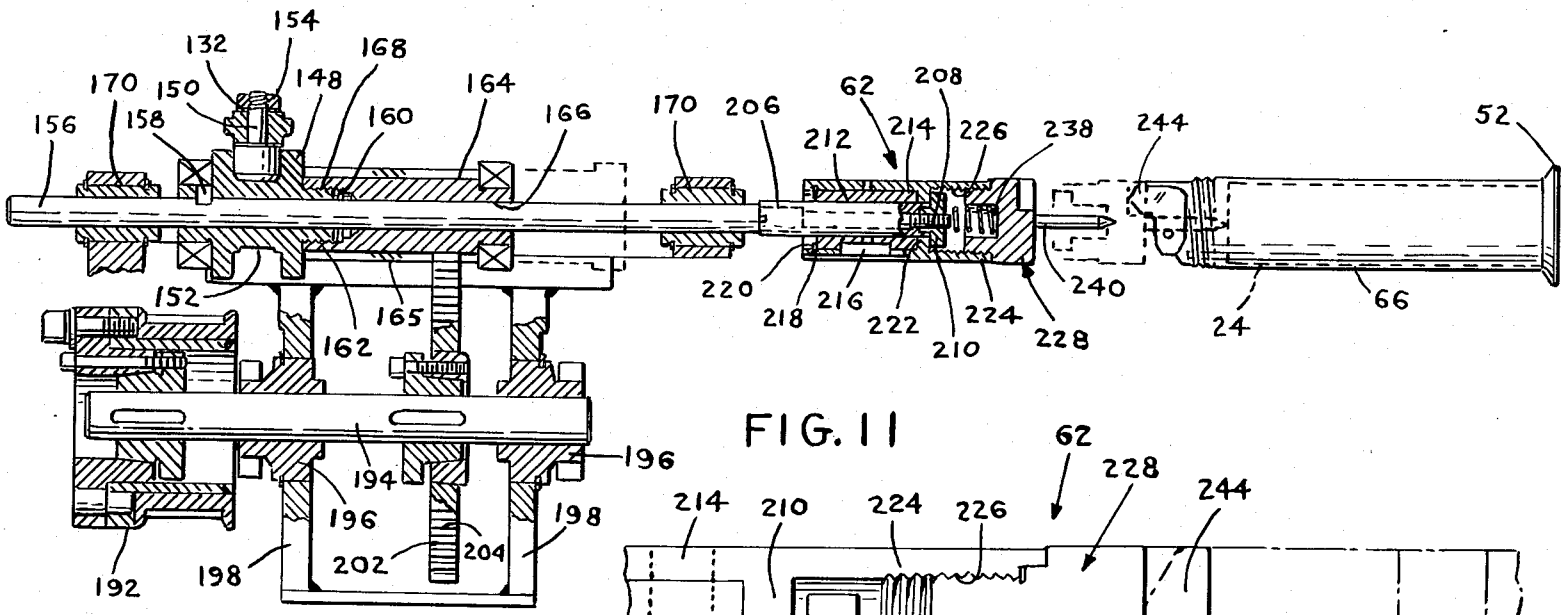
FIG. 11 is a cross-sectional view of the tube orienting mechanism of FIG. 3, taken along line 11—11 thereof.

As shown in FIG. 11, the opposite end of upper L-shaped lever 132 is secured to a yoke 148 by means of a bolt 150, which is secured within a track 152 of yoke 148 and by means of a nut 154. In this manner, upper L-shaped lever 132 is pivotally secured to yoke 148. Yoke 148, in turn, is keyed to a guide rod 156, as shown schematically at 158. Yoke 148 also includes a forward projecting section 160 having external screw threads 162 thereon. A spur gear 164 includes teeth 165, a central bore 166 though which guide rod 156 extends and corresponding internal screw threads 168 at one end thereof by which spur gear 164 is screw-threadedly received on forward projecting section 160 of yoke 148.

Guide rod 156 is slidably mounted within two linear rotary bearings 170, each of which is mounted to the machine housing so as to permit both linear sliding and rotational movement of guide rod 156. As will be explained in greater detail hereinafter, tube orienting head 62 is secured to the forward end of guide rod 156.

The above constitutes the reciprocating control assembly 64.

In operation, as cam shaft 90 is continuously rotated through coupling 92, driven shaft 78, pulley 86, belt 88, pulley 76, drive shaft 70 and motor 72, orienting cam 94 is also caused to continuously rotate. During such rotation, cam follower 122 rides within cam track 114, causing L-shaped cam lever 124 to rock about pivot shaft 126 in the direction of arrow 172, as shown in FIG. 3. This, in turn, causes reciprocation of connecting rod 128 in the direction of arrow 174 which, in turn, causes rocking of upper L-shaped lever 132 in the direction of arrow 176. As a result, guide rod 156, and thereby tube orienting head 62, is caused to move in the horizontal direction of FIG. 11 into and out of engagement with respective tubes 66. As previously discussed, tube orienting head 62 is moved into engagement with a tube 66 when cam follower 122 rides within second section 118 of cam track 114 and is caused to move in the leftward direction of FIG. 11 out of engagement with the tube 66 when cam follower 122 rides within first section 116 of cam track 114. Thus, timing of the reciprocable motion of tube orienting head 62 is in synchronism with movement of printing blanket 32, since both are driven from a common motor 72.

Referring now to FIGS. 2, 3, 11 and 14, rotating control assembly 68 is also driven by motor 72. Specifically, a pulley 180 is keyed to cam shaft 90, externally of cam housing 96, as shown in FIG. 14. An indexing mechanism 182 is secured to a vertical support 184 of the machine housing, opposite to cam housing 96. Indexing mechanism 182 is a conventional mechanism which translates continuous rotation into intermittent rotation. For example, indexing mechanism 182 may be a Model 387-P2 H28-180 indexer made by Camco Company. In this regard, indexing mechanism 182 includes an input pulley 186 and an output pulley 188. A timing belt 190 connects pulley 180 to input pulley 186 of indexing mechanism 182 for providing continuous input motion thereto. In response thereto, output pulley 188 rotates intermittently.

As shown in FIGS. 3 and 11, an upper pulley 192 is mounted on a shaft 194. Specifically, shaft 194 is rotatably journaled within bearing assemblies 196 mounted within vertical supports 198 secured to the machine housing. A timing belt 200 is wrapped about upper pulley 192 and output pulley 188 of indexing mechanism 182. as shown in FIG. 2.

A spur gear 202 has teeth 204 in mating engagement with teeth 165 of spur gear 164. As shown in FIG. 11, spur gear 202 is much thinner than spur gear 164 and is adapted to slide therealong, while the teeth of the two gears are maintained in mating engagement. Thus, spur gear 202 is always engaged with spur gear 164, regardless of the reciprocable movement thereof caused by reciprocating control assembly 64.

In operation of rotating control assembly 68, input pulley 186 is continuously rotated through timing belt 190 and pulley 180. Indexing mechanism 182 translates the continuous motion at input pulley 186 t©an intermittent rotational movement at output pulley 188, corresponding to the time when tube orienting head 62 is reciprocated into engagement with a respective tube 66. The intermittent rotational movement from output pulley 188 causes consequent intermittent rotational movement of upper pulley 192 which intermittently rotates shaft 194 and spur gear 202 mounted thereon. Spur gear 202, in turn, intermittently rotates gear 164 and thereby tube orienting head 62 only during the time when the latter is engaged with a respective tube 66, as previously described.

Thus, in accordance with the present invention, synchronization of tube orienting assembly 60 and rotation of printing blanket 32 is readily achieved by a common drive. As a result, there is no need to provide complex electronic adjustment or to continuously resynchronize the movements thereof.

Referring now to FIGS. 8–11 and 13, a detailed description of one embodiment of a tube orienting head 62 that can be used with the present invention will now be given. As shown, a spline shaft 206 is secured to the distal end of guide rod 156. Spline shaft 206 includes a screw-threaded shaft 208 at the free end thereof onto which a retaining nut 210 is received. A sleeve 212 is positioned over spline shaft 206, rearwardly of retaining nut 210 and is slidably moveable therealong in the axial or longitudinal direction of spline shaft 206. Sleeve 212, however, cannot rotate on spline shaft 206.

A bearing housing 214 is keyed to sleeve 212 by means of a key assembly 216. As shown in FIG. 11, bearing housing 214 includes an inner circumferential groove 218 at the rearward end thereof in which a retaining ring 220 is positioned, and an inwardly directed circumferential flange 222 at the forward end of sleeve 212 and which is positioned behind retaining nut 210. In this manner, bearing housing 214 is fixed to sleeve 212 and is thereby permitted to slide in the axial direction along guide rod 156 with sleeve 212.

The end 224 of bearing housing 214, positioned forwardly of flange 222, extends past retaining nut 210 and includes internal screw threads 226. An orienting nose 228 of tube orienting head 62, which is shown in greater detail in FIGS. 8–10, includes an enlarged head 230 having a rearwardly extending circumferential projection 232 having external screw threads 234 by which enlarged head 230 is screw-threadedly secured to the internal screw threads 226 of end 224 of bearing housing 214. Projection 232 includes a spring retaining bore 236 within which one end of a helical spring 238 is received, the other end abutting against retaining nut 210. In this manner, helical spring 238 normally biasses bearing housing 214 and orienting nose 228, as an integral assembly, to the position shown in FIG. 11 in which circumferential flange 222 abuts against retaining nut 210. When an external force is applied against orienting nose 228, the latter is moved in the leftward direction of FIG. 11, against the force of helical spring 238, along with bearing housing 214 and sleeve 212.

In the case where it is desired to align a tube 66 used for a pump top toothpaste holder, a guide rod 240 is centrally secured to the front face of enlarged head 230 and is adapted to engage within a central aperture 242 of tube 66.

Figure 13:
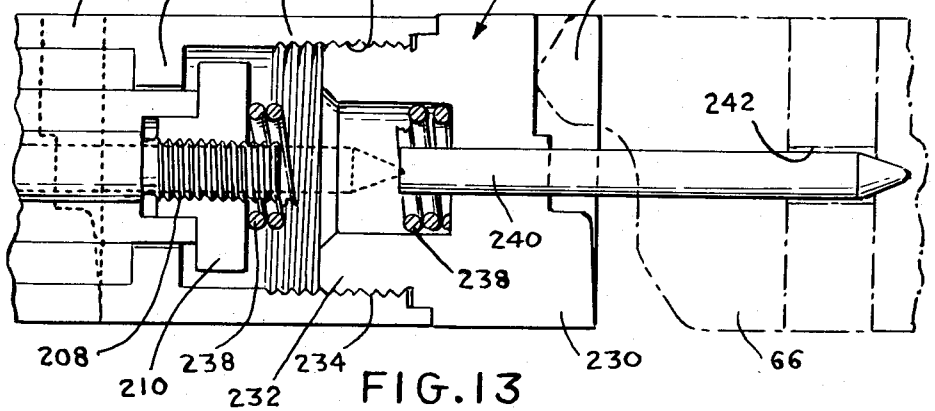
FIG. 13 is a schematic, cross-sectional view of the tube orienting mechanism of FIG. 3, taken along line 13—13 thereof.

As shown in FIGS. 11 and 13, a pump type toothpaste tube 66 includes a forwardly projecting spout 244 which is centrally offset and through which toothpaste is dispensed. In such case, the front face of enlarged head 230 includes a notch 246 for engaging spout 244 and a helically sloping surface 248 which leads spout 244 into notch 246 when helcially sloping surface 248 is engaged by spout 244 and tube orienting head 62 is caused to rotate.

In operation, when a tube 66 is moved to the nine o'clock position of mandrel wheel 22, reciprocating control assembly 64 reciprocates tube orienting head 62 forwardly into engagement with tube 66. Specifically, guide rod 240 is inserted within central aperture 242 of tube 66 and, at the same time, spout 244 hits against helically sloping surface 248. During this time, orienting nose 228 and bearing housing 214 are moved rearwardly against the force of spring 38, as shown, for example, by the dashed lines in FIG. 13. When reciprocating control assembly 64 so moves orienting head 62 into engagement with tube 66, rotating control assembly 68 rotates orienting head 62. At such time, tube 66 does not rotate with tube orienting head 62, but merely slides along helically sloping surface 248 until it reaches notch 246, whereupon spout 244 becomes engaged within notch 246. Thereafter, tube 66 rotates with tube orienting head 62. After rotating control assembly 68 rotates tube orienting head 62 a predetermined amount, tube 66 is automatically aligned at the correct printing position with respect to printing head 32. Thereafter, tube orienting head 62 is retracted from tube 66 by reciprocating control assembly 64. Thereafter, tube 66 is rotated by engaging printing blanket 32.

In order to initially align tube 66, pulley 192, for example, can be rotated, while maintaining belt 200 stationary, while the machine is stopped, until the desired printing position is obtained. Thereafter, during normal printing operations, there will always be synchronization between printing blanket 32, reciprocating control assembly 64 and rotating control assembly 68 due to the common drive used for all three assemblies.

It will be appreciated that, although the present invention has been described specifically with respect to a pump top toothpaste dispensing tubes, the present invention can be used with a multiplicity of tubes having different configurations and, in such case, the front face of enlarged head 230 may also have different configurations.

Having described a specific preferred embodiment of the invention with reference to the accompanying drawings, it is to be understood that the present invention is not limited to that precise embodiment, and that various changes and modifications may be effected therein by one of ordinary skill in the art without departing from the scope and spirit of the invention as defined by the appended claims.

What is claimed is:

1. A tube printing apparatus comprising:

rotatable mandrel wheel means for successively moving tubes to be printed to different stations of said tube printing apparatus;

a plurality of mandrel means for holding said tubes on said mandrel wheel means;

a printing station including printing blanket means for printing tubes successively moved to said printing station in contact with said printing blanket means;

tube orienting means for circumferentially orienting said tubes successively moved to said printing station;

common drive means connected to said printing blanket means and said tube orienting means for synchronously controlling said tube orienting means to orient said tubes successively moved to said printing station in correspondence with movement of said printing blanket means such that said printing blanket means always applies print at the same circumferential position of said tubes; and said tube orienting means including tube orienting head means for engaging said tubes successively moved to said printing station, reciprocating control means connected to said common drive means for reciprocating said tube orienting head means into engagement with each tube as it is moved to said printing station and away from each respective tube when said printing blanket means starts printing said respective tube, and rotating control means connected to said common drive means for rotating said tube orienting head means when the latter is reciprocated into engagment with a tube to thereby rotationally orient the tube at a desired position.

2. A tube printing apparatus according to claim 1; wherein said common drive means includes a continuously rotated common drive shaft; and said rotating control means includes indexing means for translating said continuous rotational movement of said common drive shaft to an intermittent rotational movement, and means for intermittently rotating said tube orienting head means in response to said intermittent rotational movement from said indexing means.

3. A tube printing apparatus according to claim 2; wherein said means for intermittently rotating said tube orienting head means includes a guide rod upon which said tube orienting head means is fixed, means for rotatably supporting said guide rod, a first gear secured to said guide rod and a second gear in meshing engagement with said first gear for rotating said first gear, and thereby said guide rod and tube orienting head, in response to said intermittent rotational movement from said indexing means.

4. A tube printing apparatus according to claim 3; wherein said means for intermittently rotating said tube orienting head means further includes a shaft upon which said second gear is secured, means for rotatably supporting said shaft, a pulley secured to said shaft and a timing belt connecting said pulley to an output pulley of said indexing means.

5. A tube printing apparatus according to claim 1; wherein said common drive means includes a continuously rotated common drive shaft; and said reciprocating control means includes cam means continuously rotated by said common drive shaft and having a circumferential cam track with first and second sections axially offset from each other, a cam follower positioned within said cam track, a guide rod upon which said tube orienting head means is secured, support means for supporting said guide rod in an axially sliding relation, and linkage means connecting said guide rod and said cam follower for intermittently reciprocating said guide rod, and thereby said tube orienting head means, in a direction toward and away from said tubes successively moved to said printing station.

6. A tube printing apparatus according to claim 5; wherein said linkage means includes a pivotally connected L-shaped cam lever having a first end connected to said cam follower and a second end, a pivotally connected second L-shaped lever having a first end connected to said guide rod and a second end, and a connecting rod connecting said second ends of said L-shaped levers.

7. A tube printing apparatus according to claim 5; wherein said rotating control means includes indexing means for translating said continuous rotational movement of said common drive shaft to an intermittent rotational movement, and means for intermittently rotating said tube orienting head means in response to said intermittent rotational movement from said indexing means.

8. A tube printing apparatus according to claim 7; wherein said support means rotatably supports said guide rod; and said means for intermittently rotating said tube orienting head means includes a first gear secured to said guide rod and a second gear in meshing engagement with said first gear for rotating said first gear, and thereby said guide rod and tube orienting head, in response to said intermittent rotational movement from said indexing means.

9. A tube printing apparatus according to claim 8; wherein said means for intermittently rotating said tube orienting head means further includes a shaft upon which said second gear is secured, means for rotatably supporting said shaft, a pulley secured to said shaft and a timing belt connecting said pulley to an output pulley of said indexing means.

10. A tube printing apparatus according to claim 1; wherein each tube includes an eccentrically positioned projecting spout; and said tube orienting head means includes a front face having a notch for engaging said spout and a helically sloping surface for initially contacting and moving said spout into said notch.

* * * * *

UNITED STATES PATENT AND TRADEMARK OFFICE

CERTIFICATE OF CORRECTION

PATENT NO. : 4,669,376

DATED : June 2, 1987

INVENTOR(S) : JAMES DOMINICO, CARLOS E. FARDIN AND RALPH G. ALESSIO

It is certified that error appears in the above-identified patent and that said Letters Patent is hereby corrected as shown below:

On the face of the Patent, within Item [73], please change "Van Dem Machine Corporation" to --Van Dam Machine Corporation--

Signed and Sealed this

Sixth Day of October, 1987

*Attest:*

DONALD J. QUIGG

*Attesting Officer*

*Commissioner of Patents and Trademarks*